United States Patent [19]

Nieuwendijk et al.

[11] Patent Number: 4,484,037

[45] Date of Patent: Nov. 20, 1984

[54] RIBBON-TYPE ELECTRO-ACOUSTIC TRANSDUCER WITH LOW DISTORTION AND IMPROVED SENSITIVITY

[75] Inventors: Joris A. M. Nieuwendijk; Wilhelmus D. A. M. van Gijsel, both of Eindhoven, Netherlands

[73] Assignee: U.S. Philips Corporation, New York, N.Y.

[21] Appl. No.: 378,562

[22] Filed: May 17, 1982

[30] Foreign Application Priority Data

May 26, 1981 [NL] Netherlands ..... 8102572

[51] Int. Cl.[3] ..... H04R 9/02

[52] U.S. Cl. ..... 179/115.5 PV

[58] Field of Search ..... 179/115 V, 115.5 PV, 179/119 R, 117, 115.5 ES, 115.5 R

[56] References Cited

U.S. PATENT DOCUMENTS

| | | | |
|---|---|---|---|
| 4,001,522 | 1/1977 | Kasatkin | 179/115 V |
| 4,156,801 | 5/1979 | Whelan | 179/115.5 PV |
| 4,276,452 | 6/1981 | Suyama | 179/115.5 PV |
| 4,281,223 | 7/1981 | Ugaji | 179/115.5 PV |
| 4,413,160 | 11/1983 | Ohyaba | 179/115 V |

FOREIGN PATENT DOCUMENTS

| | | | |
|---|---|---|---|
| 526901 | 9/1940 | United Kingdom | 179/115 V |
| 639134 | 3/1947 | United Kingdom | 179/115 V |
| 776782 | 6/1957 | United Kingdom | 179/115 V |

*Primary Examiner*—Gene Z. Rubinson
*Assistant Examiner*—L. C. Schroeder
*Attorney, Agent, or Firm*—Robert T. Mayer; Bernard Franzblau

[57] ABSTRACT

A ribbon-type electro-acoustic transducer has a magnet system which comprises an upper plate (2, 3) and a center pole (1) between which an air gap (8) is formed. A diaphragm (7) on which conductors (9) are arranged is disposed in the air gap. The upper plate (2, 3) comprises two plate-shaped parts (2', 3' and 2'', 3'' respectively) between which a space (11) is formed in which an edge portion of the diaphragm is located. This results in a more homogeneous magnetic field so that the transducer distortion may be reduced. Moreover, the transducer sensitivity is improved and is suitable for handling signals in the mid-range audio frequency spectrum. The cavity (15) enclosed by the magnet system and the diaphragm (7) can be acoustically coupled, be via an additional cavity to a (bass-reflex) duct or an additional (passive radiator) diaphragm.

19 Claims, 3 Drawing Figures

RIBBON-TYPE ELECTRO-ACOUSTIC TRANSDUCER WITH LOW DISTORTION AND IMPROVED SENSITIVITY

The invention relates to an electro-acoustic transducer which comprises a magnet system including an upper plate and a centre pole between which at least one air gap is formed, and a diaphragm disposed in the air gap with at least one conductor arranged thereon.

Such an electro-acoustic transducer is shown in U.S. Pat. No. 4,273,968. The transducer revealed in said patent (see for example FIG. 4) has the disadvantage that the distortion components in the output signal are comparatively large and its sensitivity is comparatively low.

It is an object of the invention to provide an electro-acoustic transducer which gives rise to a lower distortion and has a higher sensitivity and which is moreover suitable for operation in the mid-range audio-frequency spectrum. To this end the electro-acoustic transducer according to the invention is characterized in that the upper plate comprises two plate-shaped parts, which parts have major surfaces which face each other and extend parallel to the plane of the diaphragm and are situated at least substantially in the plane of the diaphragm, portions of the facing major surfaces bounding a space in which an edge portion of the diaphragm is located. The insight which is the basis of the invention is that in order to obtain a low distortion and a high sensitivity, it is not only important to have an optimum concentration of the magnetic field at the location of the conductors, but it is equally important that, at the location of the conductor(s), the magnetic field be oriented at least substantially in the plane of the diaphragm.

In the known transducer the field lines of the magnetic field extend obliquely through the plane of the diaphragm, which results in a substantial loss of useful field strength. This is because the drive is provided only by the field strength component in the plane of the diaphragm. Moreover, the magnetic field in the air gap is not homogeneous (i.e. the field strength at the location of the diaphragm does not remain constant when the diaphragm moves, especially for large excursions of the diaphragm). This gives rise to substantial distortion in the output signal of the transducer. In addition, the field-strength component perpendicular to the plane of the diaphragm, which component does not assist in driving the diaphragm, is a source of distortion. This component gives rise to excursions of the diaphragm in the plane of the diaphragm, which is undesirable. By dividing the upper plate, in accordance with the invention, into two plate-shaped parts and arranging the diaphragm in a plane between these parts, it is achieved that the magnetic field lines at the location of the conductors are at least substantially oriented in the plane of the diaphragm and perpendicularly to the conductors so that the magnetic field is utilized to a maximum extent for driving the diaphragm. Moreover, it results in a more homogeous field at the location of the diaphragm. This has the following advantages.

Firstly as a result of the higher sensitivity of the transducer, driving is possible by means of amplifiers having a lower output power or, if amplifiers having a higher output power are used, these amplifiers need not be driven to the maximum extent, thereby reducing the distortion in the drive signals from these amplifiers.

Secondly, the magnetic field in the air gap, especially in that part of the air gap which is nearest the upper plate, is very homogeneous and, in addition, excursions of the diaphragm in the plane of the diaphragm are substantially precluded because the field-strength component perpendicular to the plane of the diaphragm is virtually absent. This results in a significant reduction of the distortion in the transducer output signal.

Thirdly, since the diaphragm extends from the air gap into a space between the plate-shaped parts of the upper plate, it is possible to employ a diaphragm whose surface area is larger than the area of the air gap between the centre pole and the upper plate. This is an advantage because diaphragms which inherently produce sound with a low distortion should be taut. As a result of this the lowest resonant frequency of the diaphragm increases, so that the operating frequency range of the transducer is shifted towards higher frequencies when this transducer is employed as a loudspeaker. This may be undesirable. By increasing the dimensions of the diaphragm, which is possible with the transducer in accordance with the invention, the lowest resonant frequency of the diaphragm can be reduced. This even enables the transducer to be used for the reproduction of the mid-range audio spectrum. Moreover, it is possible to insert a damping material in the space between the two plate-shaped parts in such manner that this damping material is in mechanical contact with the vibrating portion of the diaphragm located inside said space and damps out higher vibration modes (i.e. vibration modes corresponding to higher natural frequencies of the diaphragm). Since the vibrating portions of the diaphragm which are disposed inside the space do not significantly contribute to the acoustic power output (which is mainly provided by that part of the diaphragm on which the conductors are arranged), arranging the damping material against the diaphragm will hardly affect the acoustic power radiated by the transducer.

In another embodiment of the electro-acoustic transducer in accordance with the invention, the centre pole extends to a location nearest the diaphragm surface, the diaphragm portion situated nearest the centre pole being freely movable. This ensures that, also near the diaphragm portion close to the centre pole, the magnetic lines of field extend almost immediately in the plane of the diaphragm or in a plane parallel thereto. This provides an additional increase in sensitivity and, moreover, an additional reduction of the distortion in the transducer output signal. A further embodiment of the electro-acoustic transducer in accordance with the invention is characterized in that the centre pole comprises two parts which extend one on each side of the plane of the diaphragm, the part of the diaphragm disposed between the two parts of the centre pole being freely movable. The arrangement of the upper plate and centre pole is then substantially mirror-symmetrical viewed from the plane of the diaphragm, which also provides an increased sensitivty and a reduced distortion. A preferred embodiment of the electro-acoustic transducer in accordance with the invention is characterized in that the parts of the centre pole and the upper plate disposed on one side of the plane of the diaphragm are shaped in such a way that the end surfaces of these parts which face the air gap diverge in a direction perpendicular to and away from the diaphragm surface, so that a horn-like radiation port is obtained. This improves the impedance matching between the sound-radiating diaphragm and the medium into which the acoustic signals are radiated, which means an increased radiated power. Another preferred embodiment of the electro-acoustic transducer in accordance with the invention is characterized in that the diaphragm has a rectangular shape and is curved in a direction corresponding to the direction of the conductor(s) in an air gap. In electro-acoustic transducers comprising a diaphragm of rectangular shape the directional response pattern of the radiated sound, viewed in a plane perpendicular to the diaphragm surface and perpendicular to the conductor(s) in an air gap, is comparatively wide, i.e. almost independent of the angular direction. This is because the dimension of the diaphragm in a direction perpendicular to said conductors is generally small compared with the dimension of the diaphragm in a direction perpendicular thereto. The gap width is namely selected to be small in order to obtain a maximum magnetic field in the gap, yielding a high transducer-sensitivity. In the direction perpendicular thereto, i.e. in a direction corresponding to the longitudinal direction of the conductors in the air gap, the diaphragm generally has a larger dimension (as a result of this the surface area of the diaphragm is nevertheless large, so that the radiated acoustic power is still high). This means that the directional response pattern of the sound radiated by the transducer, viewed in a plane perpendicular to the diaphragm surface and parallel to the longitudinal direction of the conductors in the air gap, is narrow and becomes narrower with increasing frequencies. In order to obtain a directional response pattern having a wider aperture angle in said plane, the dimension of the diaphragm in the longitudinal direction of the conductor could alternatively be reduced, as appears from the foregoing. However, this would reduce the diaphragm area and hence the acoustic output power, which is undesirable. By applying the step in accordance with the invention, a wider aperture angle is obtained, which is moreover substantially frequency-independent, without such a reduction of the size of the diaphragm. Within this aperture angle the directional response pattern of the transducer is substantially constant. Moreover, this does not have the disadvantage of resulting in a reduced acoustic output power.

An electro-acoustic transducer which comprises a magnet system, which magnet system comprises an upper plate and a centre pole between which at least one airgap is formed, and a diaphragm disposed in the air gap, on which diaphragm at least one conductor is arranged, can also be characterized in that the magnet system and the diaphragm enclose a cavity which is acoustically coupled, as the case may be via an additional cavity, to a duct. The dimensions of the duct are tuned to the volume of the cavity (cavities) in such a way that the low frequency behaviour of the transducer is improved, i.e. so as to lower the lower limit frequency of the transducer frequency characteristic.

The (bass)reflex principle in itself is known for example from "Acoustics", L. L. Beranek, part 20 "Bass-reflex enclosures" page 239. The application of the (bass) reflex principle in ribbon type transducers in general, such as those shown in U.S. Pat. No. 4,273,968, or in ribbon type transducers in accordance with claim 1 of the present invention, however, is not known. By means of this measure it is possible to extend the working range of the transducer to lower frequencies. Moreover, the distortion in the output signal of the transducer is significantly reduced.

An electroacoustic transducer which comprises a magnet system, which magnet system comprises an upper plate and a centre pole between which at least one air gap is formed, and a diaphragm disposed in the air gap, on which diaphragm at least one conductor is arranged, can further be characterized in that the magnet system and the diaphragm enclose a cavity which is acoustically coupled, as the case may be via an additional cavity, to an additional diaphragm which is inserted in an opening in said cavity (cavities) in such a way that the low frequency behaviour of the transducer is improved. The additional diaphragm functions here as a passive radiator.

Passive radiators in themselves are known from the Journal of the Audio Engineering Society, Vol. 22, No. 8, October 1974, pp. 592–601. A passive radiator in combination with a ribbon type transducer in general, such as that shown in U.S. Pat. No. 4,273,968, or in ribbon type transducers in accordance with claim 1 of the present invention, however, is not known. By means of this measure it is also possible to obtain an extension of the frequency range of the transducer and a lowering of the distortion in the output signal of the transducer.

Some embodiments of the invention will now be described in more detail, by way of example, with reference to the drawing, in which.

Figure 1:
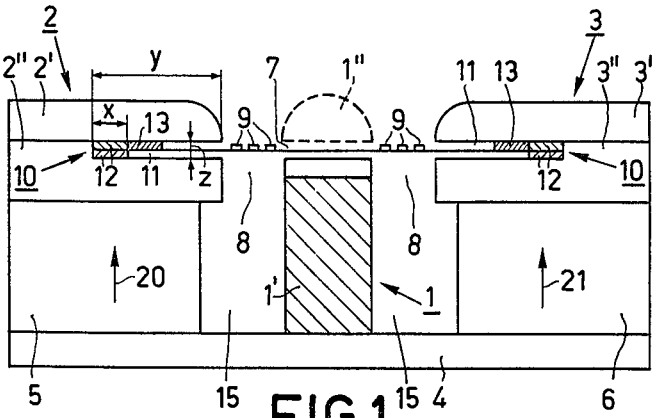
FIG. 1 shows a first embodiment of the invention.

FIG. 1 is a sectional view of an electro-acoustic transducer in accordance with the invention. The transducer may be of circular or rectangular shape. If the transducer is of rectangular shape FIG. 1 is a sectional view in a direction perpendicular to the longitudinal direction of the conductors in the air gap. The magnet system of the transducer comprises a centre pole 1, an upper plate 2, 3, a lower plate 4 and the parts 5 and 6. The magnetic field in the magnet system can be obtained by using permanent magnets for the parts 5 and 6. The direction of magnetization is indicated by the arrows 20 and 21. Alternatively, the direction of magnetization may be reversed. The other parts of the magnet system are of a soft-magnetic material, for example soft iron. If the transducer has a circular shape 5, 6 constitute the cross-section of an annular magnet. In the rectangular version 5 and 6 are the cross-sections of two rod-shaped magnets which are arranged parallel to each other. Alternatively, the parts 5 and 6 may be of a soft-magnetic material and the centre pole, or at least the shaded portion 1 thereof, may be a permanent magnet.

In the circular version an air gap 8 is situated between the upper plate 2, 3 and the centre pole 1. Both the air gap 8 and the upper plate 2, 3 are then annular. In the rectangular version air gaps 8 are situated between the upper plate 2 and the centre pole 1 and between the upper plate 3 and the centre pole 1, the two air gaps extending parallel to each other as do the upper plates 2 and 3. In the air gap (air gaps) 8 a diaphragm 7 is located on which at least one conductor 9 is arranged. This conductor extends across the diaphragm surface in a direction perpendicular to the plane of the drawing. FIG. 1 shows either three conductors which extend parallel to each other across the diaphragm surface in an air gap, or one conductor which extends across the diaphragm surface in the form of a "spiral" having three turns arranged around the centre pole. The conductors are connected to an audio amplifier (not shown) in such a way that the signal currents in the conductor(s) 9 between the upper plate 2 and the centre pole 1 flow perpendicularly to the plane of the drawing and the signal currents in the conductor(s) 9 between the upper plate 3 and the centre pole 1 flow in the opposite direction. Since the magnetic field in the air gap 8 between the upper plate 2 and the centre pole 1 extends in or parallel to the diaphragm plane (see hereinafter) and is oriented oppositely to the magnetic field in the air gap 8 between the upper plate 3 and the centre pole 1, the excursion of the diaphragm will be substantially in phase over the entire surface area. Therefore, such a transducer is sometimes referred to as an isophase transducer.

The upper plate (upper plates) 2, 3 comprises (each comprise) two plate-shaped parts 2', 3' and 2'', 3''. The two plate-shaped parts 2', 3' and 2'', 3'' are positioned against each other over a part of their facing major surfaces, which surfaces extend substantially in and parallel to the plane of the diaphragm. Another part of said major surface of one or both plate-shaped parts slightly recedes, which is indicated by 10, so that a space 11 is formed. The diaphragm 7 is arranged between the plate-shaped parts 2', 3' and 2'', 3'' in such a way that an edge portion of the diaphragm is located in the said space(s) 11. The diaphragm 7 may for example be arranged tautly on or in a frame 12 which is secured between the two plate-shaped parts. However, alternatively the diaphragm may be clamped between the parts 2', 2'' and 3', 3''. The width x of the frame 12 is smaller than the width y of the space 11. Moreover, the height z of the space 11 is such that the movable part of the edge portion of the diaphragm 7, which is located in the space 11, is freely movable and cannot contact the upper plate (upper plates) 2, 3.

The space 11 between the two plate-shaped portions may alternatively be formed by inserting, for example, a plate of a soft-magnetic material between the two facing major surfaces instead of by making at least one of the major surfaces recede. The thickness of the soft-magnetic plate will then correspond to the height z of the space 11. Since the width y of the space 11 may be increased within specific limits, which means that the diaphragm becomes wider in the sectional view of FIG. 1, the natural frequency of the diaphragm can be reduced, which results in an extension of the operating frequency range of the transducer.

In addition a damping material may be arranged in the spaces 11. The Figure shows damping material 13 which is arranged only on the upper side of the diaphragm and is in mechanical contact with the diaphragm. Preferably, however, damping material will be arranged on both sides of the diaphragm. This damping material damps the higher natural resonances of the diaphragm (these are free vibrations of the diaphragm in a resonant pattern corresponding to a natural frequency of the diaphragm and induced by driving the diaphragm), which yields an improvement in the transducer output signal because the distortion thereof is reduced. Since the diaphragm 7 is arranged between the two plate-shaped parts 2', 3' and 2'', 3'' the magnetic field in the air gap 8 extends substantially in or parallel to the diaphragm plane 7. This is in contradistinction to known transducers where the diaphragm is secured to the underside of the upper plate 2, 3 so that the magnetic field extends obliquely through the plane of the diaphragm. By moreover extending the centre pole 1 to near the diaphragm surface it is achieved that the magnet field is homogeneous in substantially the entire air gap and extends in or parallel to the plane of the diaphragm. At the location where it is nearest the centre pole the diaphragm is not connected to this centre pole and at this location the movements of the diaphragm are not impeded by the centre pole. This results in an as large as possible a vibrating surface, so that the lowest natural resonant frequency of the diaphragm and thus the lower limit of the operating frequency range of the transducer can be made as low as possible.

Suitably, the centre pole 1 also extends on the other side of the diaphragm. The part 1'' on this side of the diaphragm is represented by a broken line. The diaphragm portion located between the two parts 1 and 1'' of the centre pole is freely movable. The part 1'' is maintained in the indicated position by means of a support, not shown. For obtaining an improved impedance matching to the medium into which the transducer radiates its acoustic signals, the end surfaces of the parts 1'', 2' and 3' which face the air gap 8 are rounded. This means that, in a direction perpendicular to the diaphragm surface, these end surfaces diverge as the distance from the diaphragm surface increases so that a horn-like radiation port is obtained.

The cavity 15 formed by the magnet system and the diaphragm 7 is in most cases a closed volume. However, it is also possible to couple the cavity 15, as the case may be via an additional cavity (not shown), acoustically to a duct (also not shown) in order to improve the low frequency response of, and to lower the distortion in, the transducer. By means of this duct an acoustic transmission path can be obtained from the back side of the diaphragm to the acoustic medium in front of the diaphragm. Another possibility which serves the same purpose as a duct is, instead of a duct, to insert an additional diaphragm (not shown) in an opening in the cavity (cavities), which diaphragm functions as a passive radiator. It is obvious that the above two measures can also be applied in state-of-the-art-transducers such as that shown in U.S. Pat. No. 4,273,968 and for the same reasons, namely for lowering the distortion in the output signal of the transducer and for extending the lower limit of the working range of the transducer to lower frequencies.

Figure 2A:
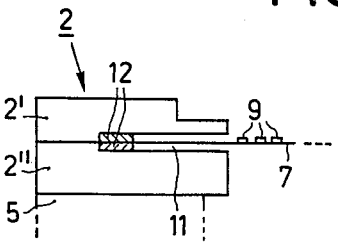
FIG. 2 shows two different shapes of the upper plate.
Figure 2B:
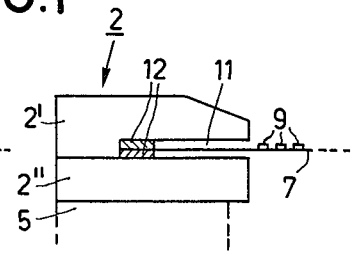

FIG. 2 is a sectional view of two further possible versions of the upper plate 2. Parts of FIGS. 1 and 2 bearing the same reference numeral are identical. FIG. 2*a* shows a construction in which the diaphragm may be clamped in position solely by means of the parts 2' and 2''. In that case the frame 12 may be dispensed with.

Figure 3:
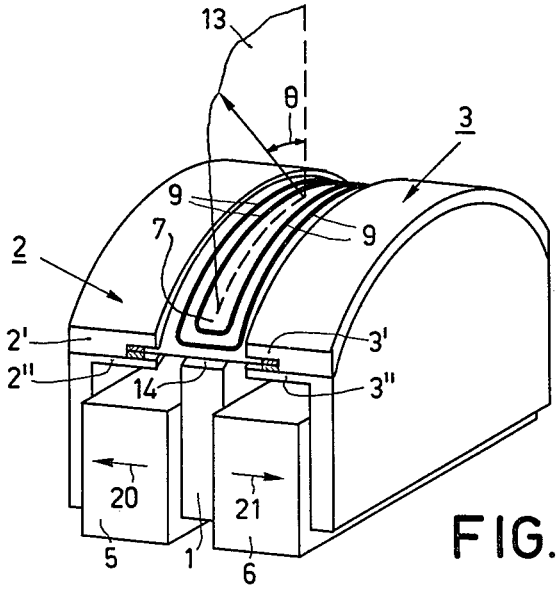
FIG. 3 shows an embodiment in which the diaphragm is curved in the longitudinal direction of the conductors.

FIG. 3 shows an embodiment of a rectangular transducer which has a diaphragm 7 which is curved in the longitudinal direction of the conductors. The magnet system is also of a different construction, although this is not essential. The rod-shaped magnets 5 and 6 have opposite directions of magnetization as indicated by the arrows 20 and 21. Obviously, the directions of magnetization may be reversed. It is also possible to use the construction described with reference to FIG. 1. The centre pole 1 extends to near the diaphragm surface. This means that the surface 14 of the centre pole 1 is also curved in a direction corresponding to the longitudinal direction of the conductors. The upper plates 2, 3 each comprise curved plate-shaped parts 2', 3' and 2'', 3''. The curvature of the diaphragm in the longitudinal direction of the conductors results in a transducer which, in the plane 13 which is perpendicular to the diaphragm surface and which extends in the longitudinal direction of the conductors, has a directional response pattern having an aperture angle which is substantially frequency-independent. Within this aperture angle the directional response pattern is substantially independent of the angle $\theta$.

It is to be noted that despite the foregoing reference to a transducer in the form of a loudspeaker, this does not mean that the invention is limited to transducers in the form of loudspeakers. The invention may also be applied to transducers in the form of a microphone. Furthermore, it will be appreciated that the invention does not only apply to transducers in accordance with the embodiments described, but that the invention may also be applied to transducers which differ from the embodiments shown with respect to points which are irrelevant to the inventive idea.

What is claimed is:

1. An electro-acoustic transducer comprising: a magnet system which comprises a pole plate and a centre pole between which at least one air gap is formed, and a diaphragm disposed in the air gap, said diaphragm having at least one conductor arranged thereon, said pole plate comprising two plate-shaped parts which have major surfaces which face each other and extend parallel to the plane of the diaphragm and situated at least substantially in the plane of the diaphragm, portions of the facing major surfaces bounding a space in which an edge portion of the diaphragm is located.

2. An electro-acoustic transducer as claimed in claim 1, wherein the centre pole extends to a location adjacent the diaphragm surface, the part of the diaphragm situated nearest the centre pole being freely movable.

3. An electro-acoustic transducer as claimed in claim 1 or 2, characterized in that the centre pole comprises two parts which are located on opposite sides of the plane of the diaphragm, the part of the diaphragm disposed between the two parts of the centre pole being freely movable.

4. An electro-acoustic transducer as claimed in claim 3, wherein parts of the centre pole and the pole plate disposed on one side of the plane of the diaphragm are shaped such that end surfaces of these parts which face the air gap diverge in a direction perpendicular to and away from the diaphragm surface, whereby a horn-like radiation port is obtained.

5. An electro-acoustic transducer as claimed in claims 1 or 2 wherein the diaphragm has a rectangular shape and is curved in a direction corresponding to the direction of the conductor(s) in the air gap.

6. An electro-acoustic transducer as claimed in claims 1 or 2 wherein the magnet system and the diaphragm enclose a cavity which is acoustically coupled to a duct, the dimensions of the duct being tuned to the volume of the cavity so as to lower the lower limit frequency of the transducer frequency characteristic.

7. An electro-acoustic transducer as claimed in claims 1 or 2 wherein the magnet system and the diaphragm enclose a cavity acoustically coupled to an additional diaphragm inserted in an opening in the said cavity, the diaphragm, as to its mass and tension, being tuned to the volume of the cavity so as to lower the lower limit frequency of the transducer frequency characteristic.

8. An electro-acoustic transducer as claimed in claims 1 or 2 wherein the magnet system and the diaphragm enclose a cavity acoustically coupled via an additional cavity to a duct, the dimensions of the duct being tuned to the volume of the cavities so as to lower the lower limit frequency of the transducer frequency characteristic

9. An electro-acoustic transducer as claimed in claims 1 or 2 wherein the magnet system and the diaphragm enclose a cavity which is acoustically coupled via an additional cavity to an additional diaphragm inserted in an opening in said cavities so as to lower the lower limit frequency of the transducer frequency characteristic.

10. An electro-acoustic transducer as claimed in claim 3 wherein the diaphragm is rectangularly shaped and is curved in the direction corresponding to the direction of said at least one conductor.

11. An electro-acoustic transducer comprising:

a magnet system which includes at least one magnet, pole plate means and a center pole, said pole plate means and said center pole being spaced apart so as to form at least one air gap therebetween, said pole plate means having a recess therein adjacent the air gap and defined by a pair of parallel facing surfaces thereof, a vibratile diaphragm disposed in the air gap and having a peripheral portion located within said recess in the pole plate means so that said pair of parallel faces extend parallel to the plane of the diaphragm and are positioned substantially in the plane of the diaphragm whereby the magnetic field in the air gap extends in or parallel to the plane of the diaphragm.

12. An electro-acoustic transducer as claimed in claim 11 wherein the center pole extends in a direction perpendicular to the plane of the diaphragm and has at least one face parallel and adjacent to the diaphragm, the part of the diaphragm adjacent to and facing said one face of the center pole being freely movable in a direction perpendicular to the plane of the diaphragm.

13. An electro-acoustic transducer as claimed in claim 11 wherein the pole plate means comprises an annular member of soft-magnetic material with the center pole located in the center thereof to form an annular air gap therewith.

14. An electro-acoustic transducer as claimed in claim 11 wherein the pole plate means comprises first and second parallel spaced apart and opposed pole plates of soft-magnetic material with the center pole located therebetween and equidistant from each pole plate.

15. An electro-acoustic transducer as claimed in claim 13 wherein the annular member is the upper pole plate, said transducer further comprising a lower pole plate extending perpendicular to the center pole for completing a magnetic circuit between the center pole and the upper pole plate.

16. An electro-acoustic transducer as claimed in claim 14 wherein the first and second pole plates comprise upper pole plates of the transducer, said transducer further comprising a lower pole plate extending perpendicular to the center pole and arranged to provide a closed magnetic circuit between the center pole and the first and second pole plates.

17. An electro-acoustic transducer as claimed in claim 11 further comprising a damping material located within at least a part of said recess so as to be in contact with at least a part of the peripheral portion of the diaphragm that is located within said recess.

18. An electro-acoustic transducer as claimed in claim 11 wherein the diaphragm is rectangular and has a curved shape in the rest position, wherein the center pole has a curved surface adjacent to and parallel to the curved surface of the diaphragm, and wherein the pole plate means comprises first and second curved pole plates located on opposite sides of the center pole.

19. An electro-acoustic transducer as claimed in claim 11 wherein a part of the peripheral portion of the diaphragm is secured within the recess in the pole plate means.

* * * * *